United States Patent [19]

Kuehnle

[11] Patent Number: 4,566,781

[45] Date of Patent: Jan. 28, 1986

[54] METHOD OF APPARATUS FOR LIQUID DEVELOPING OF ELECTROSTATIC IMAGES IN AN ELECTROPHOTOGRAPHIC IMAGING SYSTEM INCLUDING A LOOPED IMAGE CARRIER

[75] Inventor: Manfred R. Kuehnle, New London, N.H.

[73] Assignee: Coulter Systems Corporation, Bedford, Mass.

[21] Appl. No.: 510,281

[22] Filed: Jul. 1, 1983

Related U.S. Application Data

[63] Continuation-in-part of Ser. No. 328,809, Dec. 9, 1981, Pat. No. 4,410,260.

[51] Int. Cl.[4] ..... G03G 15/10

[52] U.S. Cl. ..... 355/10; 355/3 BE; 355/77; 118/661; 430/117

[58] Field of Search ..... 355/10, 3 BE, 16, 3 DD, 355/77; 118/661; 430/117–119

[56] References Cited

U.S. PATENT DOCUMENTS

| | | | |
|---|---|---|---|
| 3,893,417 | 7/1975 | York | 355/10 X |
| 4,262,998 | 4/1981 | Kuehnle et al. | 355/10 |
| 4,271,785 | 6/1981 | Dinallo et al. | 355/10 X |
| 4,303,331 | 12/1981 | Thompson | 355/3 DD |

FOREIGN PATENT DOCUMENTS

| | | | |
|---|---|---|---|
| 2038339 | 2/1972 | Fed. Rep. of Germany | 355/10 |

*Primary Examiner*—R. L. Moses

*Attorney, Agent, or Firm*—Silverman, Cass & Singer, Ltd.

[57] ABSTRACT

An apparatus and method for making copies of an original pattern through the use of electrostatic techniques in which there is a looped belt having an exterior photoconductive layer. The exterior of the belt passes through a charging station and is imaged by a projected pattern of light thereafter in darkness to acquire a latent image progressively as the belt moves in one direction. The belt passes a toning station where a toning roller dipping into a sump of toner picks up toner particulate matter and rolls the toner matter onto the latent image to develop the same as the belt passes through the toning station. The toning roller engages the belt and protrudes into the loop formed by the belt thereby requiring the belt to be wrapped around a peripheral segment of the toning roller. There is a stretched portion of the belt extending between the peripheral segment and each of a pair of guide rollers so that the toning roller is restrained only by the tension of the belt.

8 Claims, 4 Drawing Figures

METHOD OF APPARATUS FOR LIQUID DEVELOPING OF ELECTROSTATIC IMAGES IN AN ELECTROPHOTOGRAPHIC IMAGING SYSTEM INCLUDING A LOOPED IMAGE CARRIER

This application is a continuation-in-part of said copending patent application Ser. No. 06/328,809, filed 12/9/81, now U.S. Pat. No. 4,410,260.

REFERENCE TO OTHER PATENT APPLICATION

The disclosure of another patent application is hereby incorporated herein by reference. The copending patent application is identified as Ser. No. 06/328,809 filed Dec. 9, 1981, now U.S. Pat. No. 4,410,260, granted Oct. 18, 1983, in the name of Manfred R. Kuehnle, entitled "TONING APPARATUS AND METHOD" and owned by the assignee of the present patent application.

FIELD OF THE INVENTION

The field of the invention comprises generally the development of electrostatic latent images on a belt by means of electrophoretic media. More particularly the invention is concerned with the development of an electrostatic latent image formed on a flexible electrophotographic belt by means of liquid toner having particulate matter suspended therein. The invention is additionally concerned with the transfer of the developed image from the belt to a suitable transfer medium such as plain paper or a secondary belt.

BACKGROUND OF THE INVENTION

The background of this invention herein is substantially the same as the background of the invention of the referenced patent application. This invention is directed to certain improvements of the invention of the referenced patent application, the primary improvement being that instead of the belt being guided around the peripheral segment of the toning roller which it engages by means of pressure being applied through the belt by guide rollers, the guide rollers are sufficiently spaced from the toning roller so that there is a freely stretched and unsupported portion of the belt on opposite sides of toning roller. Thus, the toning roller is restrained by the belt alone thereby enabling accurate control of belt tension.

The toner carried by the toning roller into the nip formed between the toning roller and the converging exterior surface of the belt is a more or less wedge-shaped mass that starts to tone the latent image before it is compressed as it passes over the peripheral segment of the toning roller which is closely engaged by the belt. This is believed to give a better effect enabling greater densities of toning to be achieved.

An important advantage of the arrangement is that any departure from parallelism between the shafts of the toning roller and the guide rollers or between the outer surfaces of the rollers is compensated for by the flexibility of the belt. This is because there is a free, unsupported section of the belt on opposite sides of the toning roller. Even flexing of the rollers because they are supported at their ends and subjected to tension of the belt is to some extent compensated for.

Another advantage of the present arrangement is that the locations and dimensions of the guide rollers are not critical relative to the toning roller and the toning station thereby enabling simple and more convenient configurations of the belt and its guiding and driving rollers.

SUMMARY OF THE INVENTION

An apparatus and method for reproducing a pattern of predetermined subject matter on a carrier medium by transfer of a developed image to said carrier medium. The apparatus includes an endless looped belt engaged over rollers which guide and drive the same and adapted to move continuously during the imaging and transfer process. The belt has an outer layer presenting a photoconductive surface and an interior grounded ohmic layer.

The belt surface is guided to pass through a charging station, an imaging station, a toning station, a transfer station and then back to the imaging station in a continuous process. This is done with the belt moving at constant velocity. This invention is primarily concerned with the toning station and manner in which the latent image on the belt surface is toned.

The toning station comprises a sump carrying a body of liquid toner therein that is a suspension of particulate material of electrophoretic character. There is a toning roller that is partially immersed in the body of toner suspension and adapted to rotate within the suspension, either as an idler or by being driven. The belt is formed into a loop by the guide and drive rollers and the upper portion of the toning roller intrudes into this loop, pulling sections of the belt with it into a tortuous bow or jog. This is located between two guide rollers of the belt so that there is a tensioned and otherwise unsupported section of the belt which extends from the toning roller jog to each of the adjacent guide rollers.

The toning roller is pressed into the loop by some means such as spring-biasing so that the total tension of the belt is controlled by the amount of this pressure. The particulate material of the toner is plated onto the toning roller as it emerges from the sump and carried to the nip between the belt and the toning roller and enters the arcuate segment of the toning roller which engages the belt in a wedge-shaped configuration.

The surface of the toning roller is insulated and there is an electrical bias between the toning roller and the belt to effect efficient transfer of the particulate matter to the latent electrostatic image on the belt.

After development the toned image passes to the transfer station where the belt is guided by a transfer roller into engagement with a carrier medium. This can be a sheet of paper or a web of some receptor material or even a web that is intended to make a second transfer. The transfer roller is backed up by a back-up roller and there is normally a transfer voltage between the transfer roller and back-up roller to effect efficient transfer of the image to the carrier medium.

DESCRIPTION OF THE PREFERRED EMBODIMENTS

The basic structure with which the invention is concerned is one in which the end result is to obtain an image of an original pattern on some form of carrier medium through the use of electrostatic techniques. In this structure the image is first obtained on the photoconductive surface of a belt and then transferred to the carrier medium. The belt is one which passes through various stations where it is charged, toned and imaged and hence is continuously circulated in the apparatus in darkness. The pattern which it is desired to reproduce may be one which is to require the belt to circulate in its loop once or a few times, as in the case of convenience copiers or it may be one of many that the apparatus is to reproduce seriatim from a store, thus requiring that the belt circulate a large number of times. This could be in a type of apparatus where a large number of photographs or patterns are to be reproduced. Perhaps the patterns are stored digitally and there is a conversion process which occurs between the store and the belt.

The referenced application teaches similar structure but does not disclose the improvements which are made herein and which are concerned primarily with the disposition of the toning roller spaced from the guide rollers of the belt so that the guide rollers have little effect upon the belt tension and do not define the location of the toning roller in its jog or bow.

Figure 1:
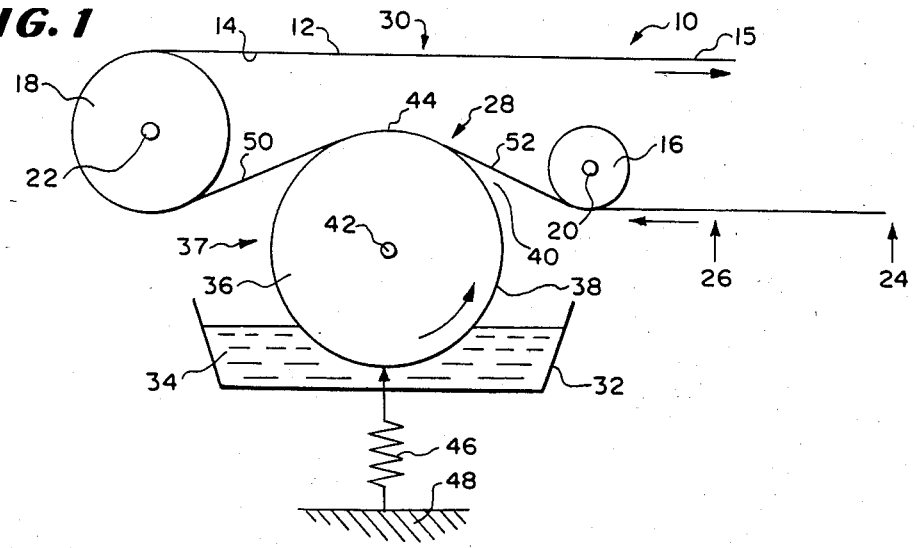
FIG. 1 is a diagrammatic view of a portion of an electrophotographic apparatus which is constructed in accordance with the invention, this being, for example, a copier apparatus similar to that which is disclosed in the referenced application.

FIG. 1 illustrates diagrammatically a portion of an electrophotographic apparatus 10 which could be a convenience copier, for example. The belt 12 has a substrate 14 which provides the principal support or strength of the belt and may be sheet metal of a flexible type or some form of synthetic resin such as polyester. The outer surface 15 of the belt is a photoconductor, such as for example that which is disclosed in U.S. Pat. No. 4,025,339. This latter material comprises a crystalline form of cadmium sulfide that is sputter deposited on the substrate 14. The thickness of the photoconductive layer 15 is preferable between one and two microns for the purpose of the invention. If the substrate is metal the deposit is directly onto the metal; if the substrate is plastic there is an intervening ohmic layer that is grounded to the framework of the apparatus 10.

The belt 12 is in the form of a circulating loop that is driven and guided by various guide rollers such as those which are illustrated at 16 and 18, suitably journalled to the framework of the apparatus 10 by way of axles and bearings such as shown respectively at 20 and 22.

In the apparatus 10, there is a charging station 24 that is located to be effective before the belt reaches the imaging station 26 where the latent image is applied to the belt 12. Then the belt passes around the guide roller 16 and through the toning station 28 where it is toned and the latent image developed. Finally the toned image passes around the guide roller 18 to a transfer station 30 where the image is transferred to a carrier medium and the belt continues to move around the same loop to perform the process over again.

At the toning station 28 there is a sump 32 containing a body of toner 34 which comprises particulate matter suspended in a suitable liquid. The liquid is an insulating material, an example of which is known as Isopar made by the Exxon Corporation. A toning roller 36 is journalled for rotation with its lower segment partially immersed in the body of toner 34 so that as it rotates it will carry the particulate material up the surface 38 to the nip 40 where the toning roller engages the outer surface of the belt 12. The journal of the toning roller 36 is symbolically indicated at 42. It will normally be mounted to the sump 32 so that the roller 37 may be pressed upward in the view, that is, against the loop of the belt 12 so as to form the bow or jog illustrated at 44. If there was no bow the belt 12 would extend in a flat plane between the rollers 16 and 18.

The toning roller 36 is shown biased upward by means of a strong spring illustrated symbolically at 46, pressing from the framework 48 of the apparatus 10.

The roller 36 may be of metal such as aluminum and its outer surface 38 is insulative, as for example, by means of anodizing. Otherwise an outer insulating sheath may be used.

The axes of the rollers 16, 18 and 36 are preferably parallel to one another and the surfaces of these rollers are preferably right cylindrical, but this does not always occur. To compensate for this the shafts or journals 20 and 22 are substantially spaced apart and the toning roller 36 is located between. The roller 36 is pressed past the plane defined by the bottoms of roller 16 and 18 into the loop of the belt 10 and thereby produces the bow or jog 44 that connects with the remainder of the belt 12 by means of straight tensed or stretched sections 50 and 52. The belt tension is thus controlled by the pressure which is exerted by the toning roller 36 against the loop of the belt 12.

Figure 2:
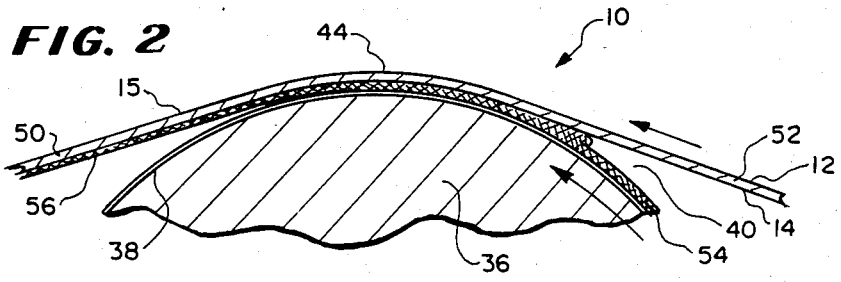
FIG. 2 is an enlarged sectional view taken generally through the crown of the toning roller where it engages the belt.

The particulate material from the body of toner 34 is carried along the surface 38 on the right hand side of the roller 36 as indicated at 54 in FIG. 2 and enters a wedge shaped area at the nip 40 where it can commence developing the latent image. Thereafter it is compressed and carried into the space between the belt 10 and the roller 36 over the crown of the roller. Thus when the belt 12 has passed over the roller it has a uniform and compacted layer of toner as shown at 56 to be carried to the transfer station 30. Of course this layer is selectively applied because of the presence of the latent image. If desired a cleaning station may follow the jog 44 at 37 to prevent carry-over of the toner in image form.

Tailing or fog may be caused by toner particles remaining in the gap between the toning roller 36 and the belt 12. The layer 54 can control this by placing a bias of minus 15 to 20 volts d.c. on the toning roller 36. The field across the belt then drives the toner particles to the latent image without intervening floaters in the carrier liquid of the gap.

The belt may be scavenged for loose particles by a suitable bias after the toning and by adjusting the tension of the belt 12 but without losing the developed image.

Another way of eliminating tailing or fog is by driving the toning roller 36 slightly faster than the speed of the belt 12. This feeds more particles to the gap. The wedge in the nip also feeds more particles to the gap and tends to force the gap apart thereby preventing the high shear velocities in the gap which produce the tailing and fog and which were characteristic of the structure where the guide rollers on opposite sides of the toning roller pinch the belt between themselves and the surface of the toning roller to produce a uniform gap along the segment of the toning roller which is engaged by the belt 12. This segment tends to be shorter in the case of the invention herein.

Figure 4:
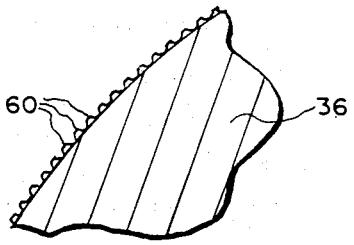
FIG. 4 is a fragmentary sectional view through the surface of a modified form of the toning roller of the invention.

It is sometimes advantageous to provide a roughened surface on the roller 36 which has small dots or feet formed of permanently bonded rubber or resin. These are shown at 60 in FIG. 4. There should be about 500 or more per square inch of surface raised about 10 microns above the surface. The purpose is to enable more toner to be held to the roller 36 as it rotates.

The benefit of the wedge arrangement which has been described at the nip 40 of the toning roller 36 is that the gradual force applied to the toner gives it time to develop the full latent image before the squeezing starts, making more efficient use and application of the toner in a selective manner. For any given degree of tension, the squeeze force is proportional to the degree of wrap so that the structure of the referenced application will result in more squeeze than contemplated herein.

The structure of the invention reduces the amount of pressure required on the bearings 20 and 22 because they do not participate in the confinement of the roller 36.

The segment of the wrap of the belt 12 around the toning roller controls the toning time along with the belt velocity and the diameter of the toning roller. Toning time is preferred between 0.05 and 0.15 second with a wrap angle between 15° and 110° around a 1.75 inch O.D toning roller 36 at belt speeds between 7 and 15 inches per second. Belt tension for good result range between about 0.5 and 2 pounds per inch of width of the belt 12. The belt tension controls the wetness of the image that is developed, that is, a lower tension produces a wetter image. The nature of the carrier medium to which the image is transferred must be taken into consideration. For example, rough and porous paper would require a wetter image and lower tension.

Figure 3:
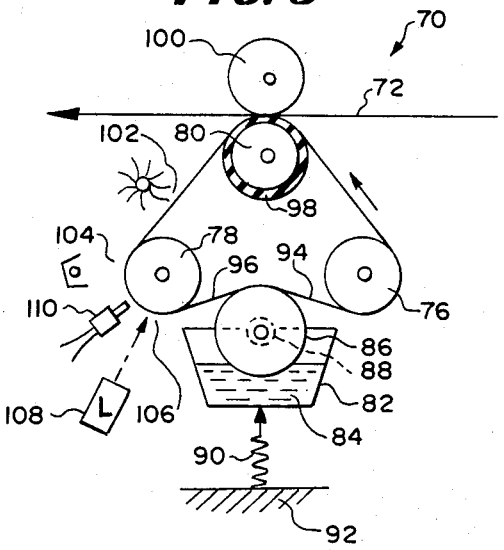
FIG. 3 is a diagrammatic view of a portion of an electrophotographic apparatus which is a modified form of the invention.

In FIG. 3 there is illustrated diagrammatically another form of the invention. Here the apparatus 70 is intended for transferring an image to a web 72 which moves continuously through the apparatus. The apparatus 70 may have several of the structures shown in FIG. 3 along the web 72, each applying a different color or a different but synchronized pattern to the belt to achieve a composite image. The web 72 may be the ultimate carrier medium or may transfer the composite image to a different carrier medium.

The structure of FIG. 3 comprises a circulating belt 74 being driven and/or guided by rollers 76, 78 and 80 in a counterclockwise direction in synchronism with the movement of the web 72. There is a sump 82 carrying a body of liquid toner 84 having particulate matter suspended therein, mounting the toning roller 86 on the bearings 88. The sump 82 is biased upward by the spring 90 engaged against the framework 92 of the apparatus 70. The rollers 76 and 78 are spaced apart a sufficient distance so that the toning roller 86 engages the loop of the belt 74 to provide the stretched sections 94 and 96.

The roller 80 has a resilient surface 98 to press the belt 74 against the backup roller 100 to transfer the developed image on the belt to the underside of the web 72. After the belt passes around the roller 80 it is cleaned at 102, charged at 104, imaged at 106 either by projection or by suitable laser beam or beams 108 and passes over the toning roller 86. The charge may be measured for any suitable purpose by an electrometer 110.

Operation of the structure of FIG. 3 is believed obvious, the same principles of apparatus 10 applying here. The principal difference lies in the configuration of the belt 74.

The versions of the invention which have been specifically illustrated and described should be understood to be merely the preferred embodiments. The invention is capable of wide variation and modification in many different forms and details without departing from the spirit or scope of said invention as defined in the appended claims.

What it is claimed and desired to be secured by Letters Patent of the United States is:

1. A method of toning the latent image formed on the exterior of a looped electrophotographic belt having a photoconductive layer on its exterior surface, said belt extending between and looped around a plurality of rollers supporting the same including two spaced apart rollers, the belt moving in a reach between the two spaced apart rollers which would define a flat tangential plane if passed directly between the two rollers without being disturbed, in which the latent image is formed on the belt and appears on the exterior surface of said reach and is adapted to pass along said reach toward one of the two spaced apart support rollers, there being a toning station adjacent said reach and located between the two spaced apart support rollers, the latent image being required to pass through said toning station before passing around said one support roller, said method comprising:

A. providing a sump at said toning station, said sump containing a body of liquid toner material and a resiliently biased toning roller having its axis parallel with the axes of said support rollers, one portion of said toning roller being engaged in said body of liquid toner material, B. spreading the spaced apart rollers and also pressing the toning roller while still in said body of liquid toner material toward said reach to such an extent that a second portion of said toning roller circumferentially spaced from said one portion intrudes past said plane inwardly of the loop and engages said belt to establish an inward bow offset from said plane defining a nip and a free section of the belt providing reach portions of said belt extending between said second portion of said toning roller and each of said support rollers, the reach portions being under tension and free of said rollers, a substantial area of said reach being so engaged with an arcuate segment of said second portion of said toning roller at a wrap angle between 15° and 110° relative to the arcuate segment, C. driving one of said plurality of rollers to cause movement of said belt to bring the latent image into said toning station and D. rotating the toning roller at a speed which provides a circumferential movement when engaged with the belt that is at least equal to the movement of the belt, such toning roller acting to pick up onto said one portion of its surface toner material from said body bringing it into the nip between the toning roller and the belt as the belt engages said second portion of said toning roller defining an entrance to said nip, the entrance having a wedge-shaped configuration leading to the nip whereby to apply a gradual force to the toner carried by the toner roller into the entrance leading toward the nip before squeeze thereof is initiated to develop the latent image primarily within said entrance as the belt passes through the toning station.

2. The method as claimed in claim 1 in which the toning roller is driven at a speed which provides a circumferential movement when engaged with the belt that is slightly faster than said movement of the belt.

3. The method as claimed in claim 1 in which simultaneously with pressing the toning roller into said inward bow a toning bias voltage is applied to said toning roller and the belt of such polarity as to drive the toner material into development relationship with the latent image of the belt.

4. In an apparatus for toning a latent image in which there is a belt having an exterior photoconductive surface moving in a loop which includes a portion of said loop extending between a pair of belt supporting rollers, said pair of rollers defining a plane tangential to both through which the belt would move if not deviated between said rollers, the belt adapted to be charged at a charging station, thereafter exposed at an exposure station to produce a latent image on the belt, the belt adapted thereafter to carry said latent image into said portion between said pair of belt supporting rollers for toning said latent image as said latent image passes a nip between the toning roller and said pair of belt supporting rollers along said belt, and there being a developed image transfer station for transferring the toned image to a carrier medium, the herein invention which comprises:

said toning station including a store of liquid toner material having a rotating resiliently upwardly biased toning roller with its bottom arcuate segment engaged in said toner material and a top arcuate segment engaging the belt in said portion of said loop while extending through said plane, said toning roller deviating the belt from said plane to engage said second arcuate segment at a wrap angle between 15° and 110°, the pair of rollers being spaced apart a distance such that when the said top arcuate segment of said toning roller is so engaged with said belt there will be sections of the belt that are free of both the toning roller and each of said pair of support rollers, the sections being under tension, one section of the belt defining an entrance to the nip having a wedge-shaped configuration so that toner material will be picked up from said store, a gradual force being applied within the entrance to the toner carried by the toner roller into said entrance leading to the nip before squeeze of the toner is initiated and the toner material being transferred to said belt to develop said latent image as it passes along said second arcuate segment past the nip, the toning roller rotating at a speed at least in synchronism with said moving belt and said belt being maintained under tension between said rollers, the toning being effected while the toner traverses the entrance to the nip.

5. The invention as claimed in claim 4 in which the toning roller is driven at a speed that moves the second arcuate segment slightly faster than the belt.

6. The invention as claimed in claim 4 in which the surface of the toning roller is roughened.

7. The invention as claimed in claim 4 in which the surface of the toning roller is insulative in character.

8. The invention as claimed in claim 7 in which means are provided for applying an electrical toning bias between the toning roller and the belt.

* * * * *